US006273795B1

(12) United States Patent
Hatamoto et al.

(10) Patent No.: US 6,273,795 B1
(45) Date of Patent: Aug. 14, 2001

(54) METHOD AND APPARATUS OF DRESSING A GRINDING WHEEL

(75) Inventors: Mitsuoki Hatamoto; Hiroshi Kondo, both of Mishima; Kazunori Urushibata, Ihara-gun, all of (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/992,214

(22) Filed: Dec. 17, 1997

(30) Foreign Application Priority Data

Dec. 20, 1996 (JP) ..... 8-342090

(51) Int. Cl.[7] ..... B24B 1/00

(52) U.S. Cl. ..... 451/56; 451/60; 451/72; 451/443; 125/11.02

(58) Field of Search ..... 451/443, 72, 56, 451/60, 446, 53, 449, 450, 488, 87, 88; 125/11.22, 11.02, 11.14

(56) References Cited

U.S. PATENT DOCUMENTS 2,635,399 * 4/1953 West, Jr. ..... 51/266
3,314,410 * 4/1967 Knauer et al. ..... 125/11
4,020,820 * 5/1977 Kish ..... 125/11 R
4,027,648 * 6/1977 Bonnice ..... 125/11 R
4,083,350 * 4/1978 Zogas ..... 125/11 CP
4,103,668 * 8/1978 Nishimura et al. ..... 125/11 CD
5,664,990 * 9/1997 Adams et al. ..... 451/60

* cited by examiner

*Primary Examiner*—Timothy V. Eley
*Assistant Examiner*—Dung Van Nguyen
(74) *Attorney, Agent, or Firm*—Pillsbury Winthrop LLP

(57) ABSTRACT

Disclosed is a method of effectively dressing a grinding wheel of high grain concentration having a high wheel number usable for an ultrahigh precision processing. When a grinding wheel (10) is trued (i.e., formed into a predetermined shape) by using a truing tool (11), the grinding wheel (10) is dressed by feeding a coolant W in which abrasive grains (12) for dressing are dispersed into a space between the truing tool (11) and a surface (13) of the grinding wheel (10). Therefore, it is possible to easily true and dress the ultra-fine grinding wheel usable for ultra-high precision processing, without being affected by the manufacturing limit of the dressing tool, being different from the dressing method using a dressing tool.

6 Claims, 5 Drawing Sheets

METHOD AND APPARATUS OF DRESSING A GRINDING WHEEL

BACKGROUND OF THE INVENTION

1. Field of the Invention

The present invention relates to a method and apparatus of dressing a grinding wheel, and more specifically to a method of effectively dressing a high grain concentration grinding wheel which is usable for ultra high precision processing.

2. Description of the Prior Art

As shown in FIG. 7, when a grinding wheel 1 is formed into a predetermined shape (referred to as truing or trued, hereinafter), since abrasive grains 2 contained in the grinding wheel 1 are ground down and thereby buried under a surface 3 of the grinding wheel, it is necessary to form new cutting blades by dressing the surface 3 of the trued grinding wheel 1 again, so that binding material 4 can be cut away and thereby the abrasive grains 2 can be exposed from the surface 3 of the grinding wheel 1, as shown in FIG. 8.

Here, in order to form new cutting blades by cutting off the binding material 4 without deforming the trued grinding wheel 1, it is indispensable to set the hardness of the abrasive grains contained in a dressing tool to a value lower than that of the abrasive grains 2 contained in the trued grinding wheel 1 but higher than that of the binding material 4 of the same trued grinding wheel 1.

Further, it is also necessary to set the grain diameter of the abrasive grains contained in the dressing tool to such an appropriate grain diameter that although the abrasive grains contained in the dressing tool can enter into an appropriate depth between the abrasive grains 2 contained in the trued grinding wheel 1, the abrasive grains 2 may not fall away from the surface thereof, in relation to an averaged interval between the abrasive grains contained in the trued grinding wheel 1.

Here, when the dressing tool which contains the abrasive grains having appropriate hardness and a grain diameter is brought into frictional contact against the surface 3 of the trued grinding wheel 1 to be dressed, the cutting blades can be newly formed without deforming the trued shape of the grinding wheel 1, so that it is possible to manufacture an abradable grinding wheel 1 effectively.

However, in the case of the grinding wheel used for ultra high precision processing, the grain diameter can be smaller than several microns because of a high wheel number. Further, the grain concentration is high and thereby the averaged grain interval is extremely small. Therefore, the grain diameter contained in the dressing tool used to dress the grinding wheel for ultra high precision processing must be extremely small.

On the other hand, since the dressing tool is usually sintered without use of any binding material, there exists such a tendency that the grains are diffusion-coupled with each other and thereby the grain diameter increases. This tendency increases as the grain diameter is decreasing. As a result, it has been difficult to manufacture a dressing tool used to dress the grinding wheel containing ultra-fine grains which is usable for the ultra high precision processing.

To overcome this problem, conventionally, the grinding wheel for the ultra high precision processing is trued so far often for dressing purposes. However the dressing efficiency is not high and the wheel surface is easily made flat, this problem so far arises in the ultra high precision processing.

On the other hand, a method of dressing the grinding wheel by electrolytic processing has been developed.

However, there exist the other problems in that the power unit for the electrolytic processing is relatively costly and further it takes a relatively long time to find out the optimum conditions of the electrolytic processing.

SUMMARY OF THE INVENTION

With these problems in mind, it is the object of the present invention to provide a novel method of dressing a grinding wheel having a high grain concentration usable for ultra high precision processing.

To achieve the above-mentioned object, the present invention provides a method of dressing a grinding wheel, wherein, when the grinding wheel is trued by using a truing tool, a fluid containing dispersed abrasive grains for dressing are fed into a space between a truing tool and a surface of the grinding wheel to be trued and dressed.

Here, it is preferable that hardness of the abrasive grains for dressing dispersed in the fluid is set to such a range that the abrasive grains for dressing are harder than a binding material of the grinding wheel to be trued and dressed but softer than the truing tool and the abrasive grains contained in the grinding wheel to be trued and dressed.

Further, it is preferable that an averaged grain diameter of the abrasive grains for dressing is selected in such a way that the following relationship can be satisfied:

$$(LO-SO)<S<(LO^2/3SO)$$

where S denotes the averaged grain diameter of the abrasive grains for dressing; LO denotes an averaged grain interval of the grinding wheel to be trued and dressed; and SO denotes an averaged grain diameter of the grinding wheel to be trued and dressed.

Further, it is preferable that the fluid is a coolant used to cool the grinding wheel and the truing tool when the grinding wheel is trued by the truing tool.

Further, the present invention provides an apparatus of dressing a grinding wheel, comprising: driving means for rotating a grinding wheel to be trued and dressed; a truing tool for truing the grinding wheel; and fluid supplying means for supplying a fluid containing dispersed abrasive grains for dressing into a space between said truing tool and a surface of the grinding wheel to be trued and dressed.

In the method of dressing a grinding wheel according to the present invention, since the grinding wheel can be dressed by intervening the abrasive grains for dressing between the truing tool and the surface of the grinding wheel to be trued and dressed, it is possible to easily dress the grinding wheel of ultra-fine abrasive grains usable for the ultra high precision processing, without being affected by the manufacturing limit of the dressing tool for dressing.

Further, since the hardness range of the abrasive grains for dressing is so selected as defined above, it is possible to dress the grinding wheel by cutting away only the binding material of the grinding wheel.

Further, since the diameter of the abrasive grains is selected so as to satisfy the aforementioned relationship formula, it is possible to dress the grinding wheel effectively, without dropping the abrasive grains contained in the grinding wheel.

Further, since the abrasive grains for dressing are dispersed in the coolant, it is possible to true and dress the grinding wheel at the same time, without providing an additional dressing tool.

DETAILED DESCRIPTION OF THE PREFERRED EMBODIMENTS

The method of dressing a grinding wheel according to the present invention will be described in detail hereinbelow with reference to FIGS. 1 to 6.

Figure 1:
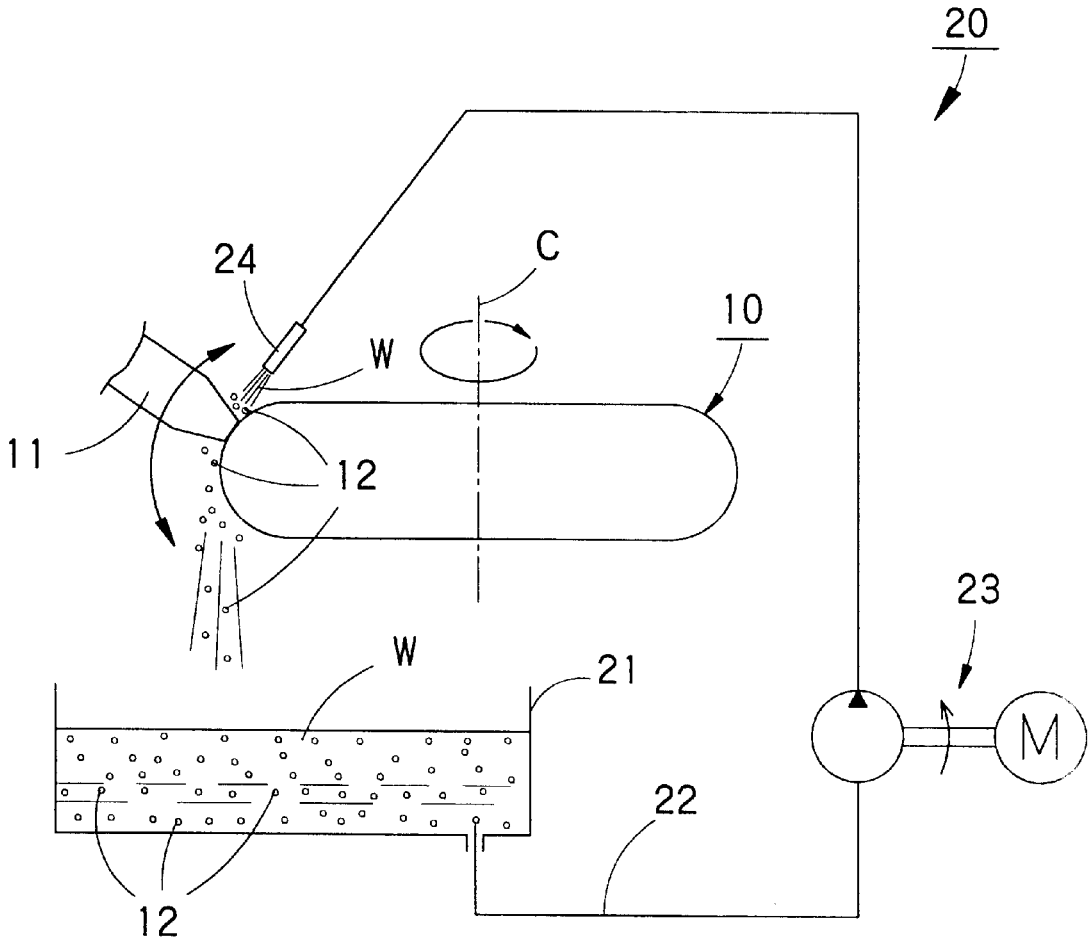
FIG. 1 is a simplified side view showing an apparatus for attaining the method of dressing a grinding wheel according to the present invention.

FIG. 1 shows an apparatus for attaining the method of dressing a grinding wheel according to the present invention. In FIG. 1, a grinding wheel 10 to be trued (i.e., formed into a predetermined shape) and dressed is rotated about a vertical rotational axis C. Further, a truing tool 11 for trueing the grinding wheel 10 moved reciprocatingly in the arrow direction is brought into friction contact with the outer circumferential surface of the grinding wheel 10 along the radial direction thereof so that the grinding wheel 10 can be trued.

Further, in FIG. 1, a coolant trap (or a pan) 21 is disposed under the grinding wheel 10 and the truing tool 11, into which coolant W for cooling both the grinding wheel 10 and the truing tool 11 is put during truing. In the coolant W, abrasive grains 12 for dressing the grinding wheel 10 are dispersed. Here, the coolant W put in the coolant trap 21 is stirred continuously by stirring means (not shown), so that the abrasive grains 12 for dressing can be fed easily toward both the grinding wheel 10 and the truing tool 11 together with the coolant W, without being precipitated at the bottom of the coolant trap 21. Further, a pump 23 driven by a motor M is disposed midway of a pipe 22 extending from the lower portion of the coolant trap 21 to a jet nozzle 24, so that the coolant W in the coolant trap 21 can be pumped up and further jetted toward an end portion of the truing tool 11 through the jet nozzle 24.

Figure 2:
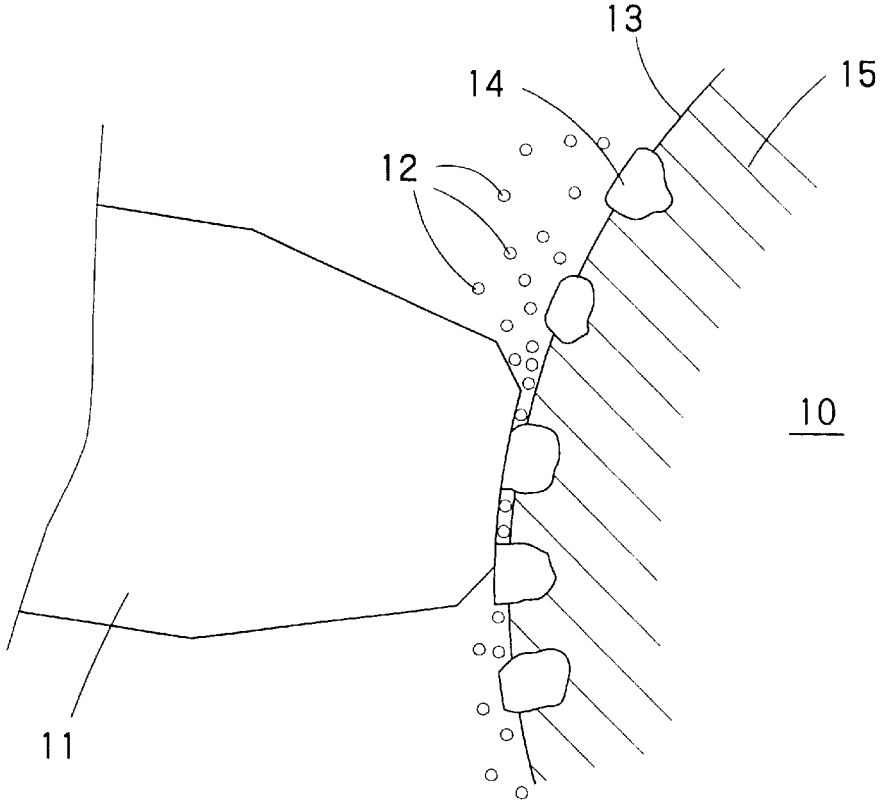
FIG. 2 is an enlarged side cross-sectional view showing a part of a grinding wheel to be trued and dressed.

Therefore, the coolant W jetted by the jet nozzle 24 can cool the grinding wheel 10 and the truing tool 11, and further feed the abrasive grains 12 for dressing into space between the truing tool 11 and the outer surface of the grinding wheel 10 as shown in FIG. 2. Further, the coolant W dropped from the grinding wheel 10 and the truing tool 11 can be collected into the coolant trap 21 and further recirculated being jetted through the jet nozzle 24. Further, relatively large-diameter grains of binding material 15 formed by fragments of the grinding wheel, for instance, are removed by using a filter (not shown) attached to an appropriate position of the apparatus.

The method of dressing a grinding wheel according to the present invention will be explained in further detail hereinbelow.

Here, the hardness of the abrasive grains 12 for dressing dispersed in the coolant W is selected in such a range that the abrasive grains 12 for dressing are softer than the truing tool 11 and the abrasive grains 14 contained in the grinding wheel 10, but harder than the binding material 15 of the grinding wheel 10.

Therefore, since the abrasive grains 12 for dressing fed into the space between the surface 13 of the grinding wheel 10 and the truing tool 11 are brought into tight contact with and further slipped along or rolled on the surface 13 of the grinding wheel 10 by the truing tool 11, only the binding material 15 of the grinding wheel 10 can be cut away, with the result that the grinding wheel 10 can be dressed by using the abrasive grains 12 for dressing. Here, as for the material of the abrasive grains 12 for dressing, it is possible to select $Al_2O_3$ as the WA family abrasive grains and SiC as the GC family abrasive grain-s.

Successively, the way of selecting the range of the grain diameter of the abrasive grains for dressing will be explained with reference to FIGS. 3 to 6.

Figure 3:
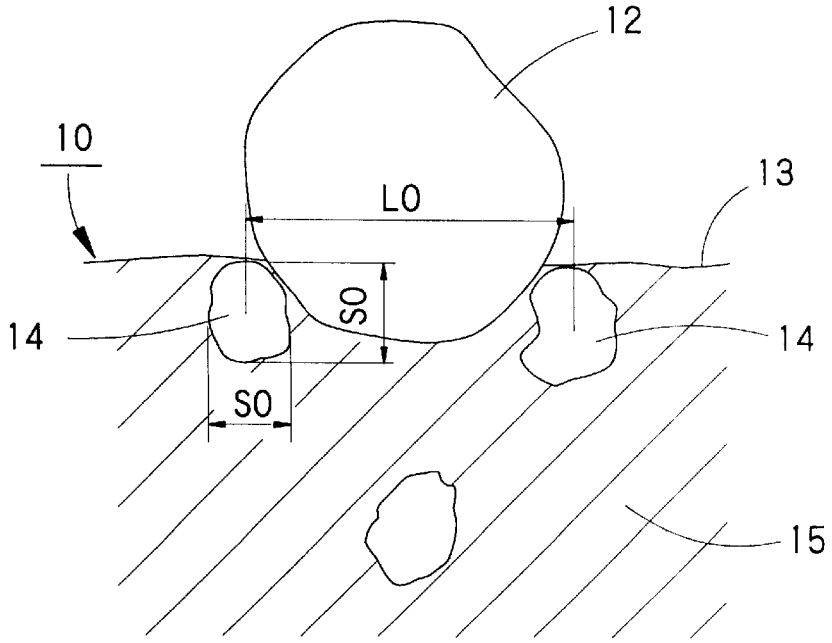
FIG. 3, is a simplified enlarged cross-sectional view showing the state where a grinding wheel is dressed by using an abrasive grain for dressing.

First, as shown in FIG. 3, the abrasive grains 12 for dressing used to dress the grinding wheel 10 must enter from the surface 13 of the grinding wheel 10 to the space between the abrasive grains 14 contained in the grinding wheel 10, so that the binding material 15 can be cut away effectively.

Figure 4:
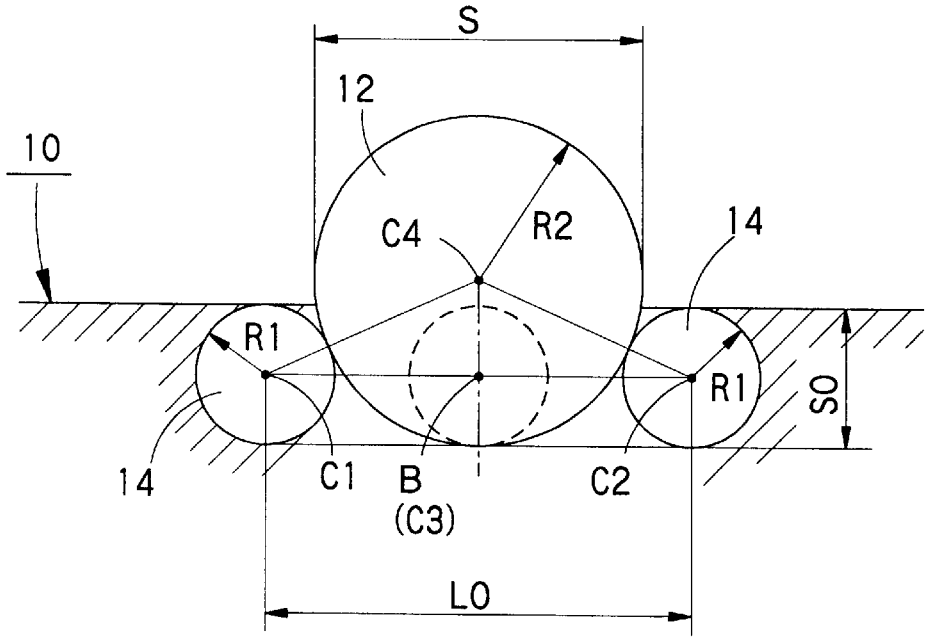
FIG. 4 is a simplified side cross-sectional view showing the mutual relationship between the abrasive grains for dressing and the abrasive grains contained in the grinding wheel.
Figure 5:
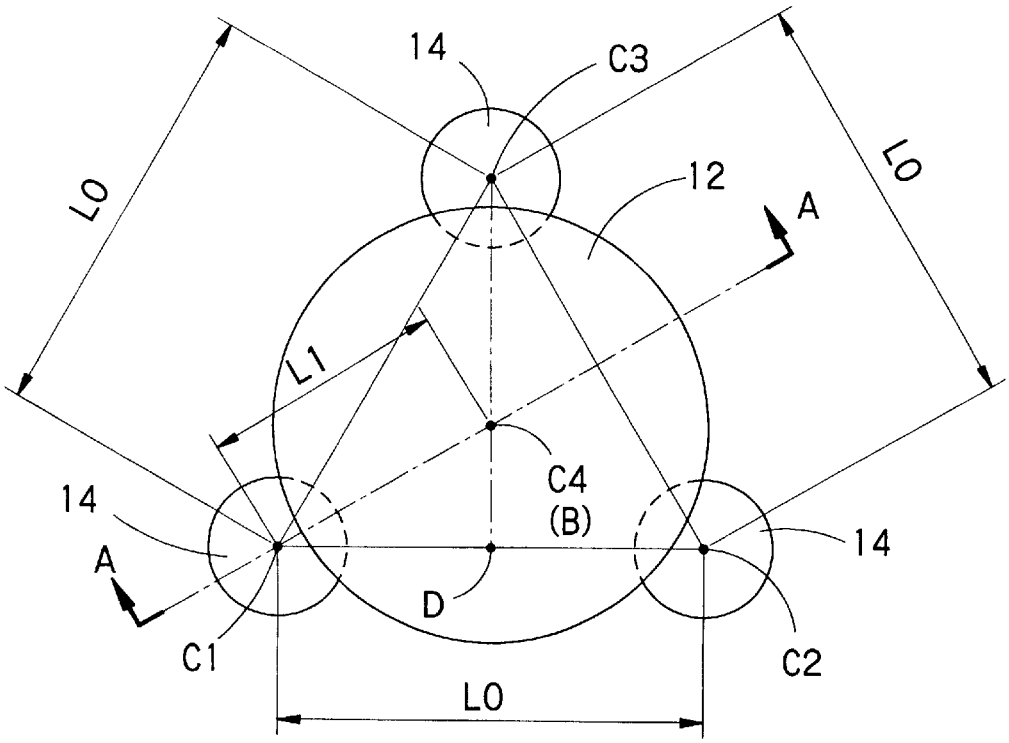
FIG. 5 is a simplified plane view showing the abrasive grain for dressing and the abrasive grains contained in the grinding wheel shown in FIG. 4.

Therefore, when the grinding wheel 10 is dressed by using the abrasive grains 12 for dressing, the following assumption is made that one abrasive grain 12 for dressing is supported by three abrasive grains 14 contained in the grinding wheel, as shown in FIG. 4 (the side view) and FIG. 5 (the plane view). Further, the grain diameter of the abrasive grains 12 for dressing which can enter from the surface 13 of the grinding wheel 10 into a depth equal to the averaged diameter SO of the abrasive grains 14 contained in the grinding wheel is assumed to be an upper limit of the grain diameter of the abrasive grains 12 for dressing which can dress the grinding wheel 10 effectively.

Figure 6:
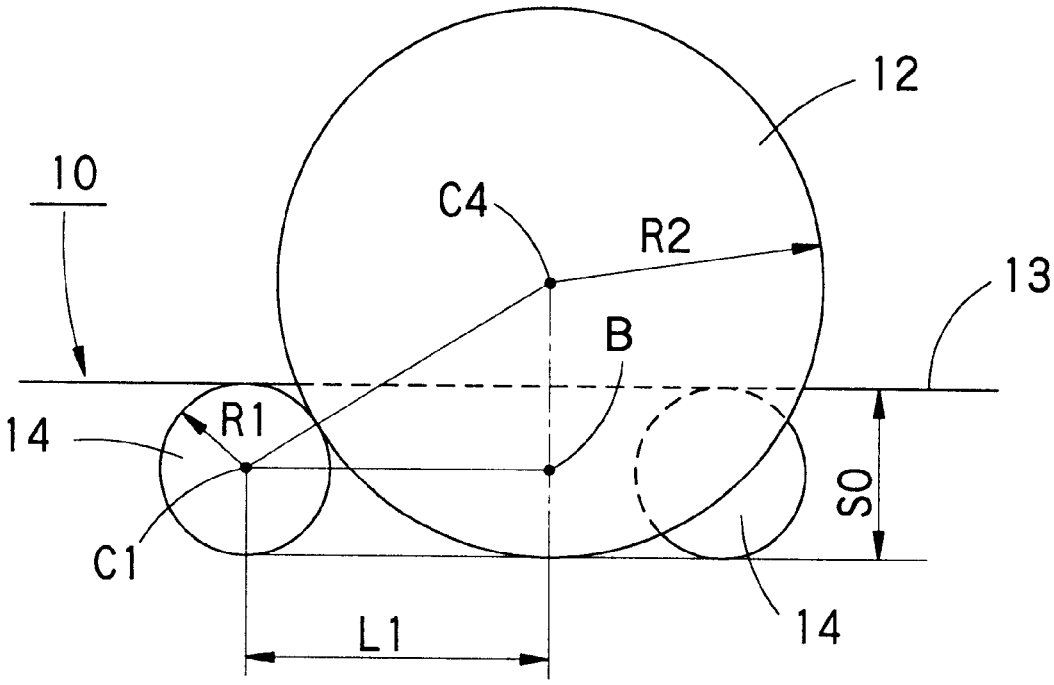
FIG. 6 is a cross-sectional view taken along a line A—A shown in FIG. 5.
Figure 7:
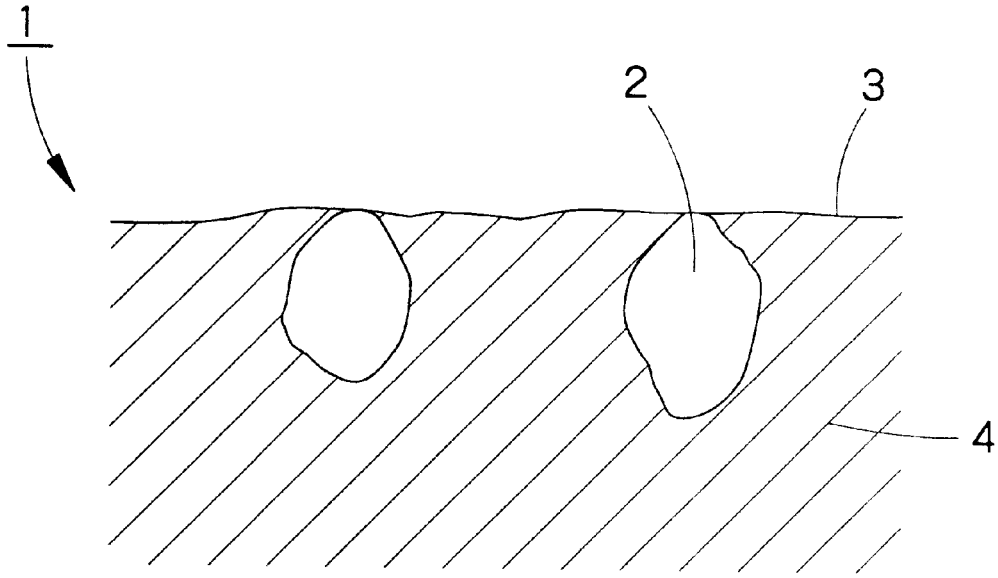
FIG. 7 is an enlarged cross-sectional view showing a surface of the trued grinding wheel.
Figure 8:
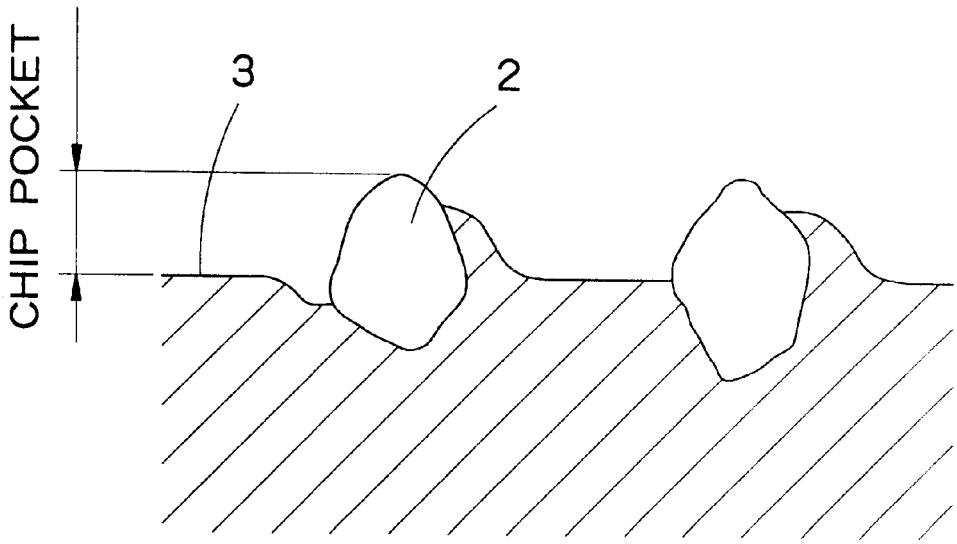
FIG. 8 is an enlarged cross-sectional view showing a surface of the dressed grinding wheel.

With this assumption as described above in mind, the models of the spherical abrasive grains 12 for dressing and the abrasive grains 14 contained in the grinding wheel are shown in FIGS. 4 to 6, respectively.

First, as shown in FIG. 4, when the grain diameter of the abrasive grains 12 for dressing are denoted by S; the grain diameter of the abrasive grains 14 contained in the grinding wheel 10 is denoted by SO; and the averaged intervals of the abrasive grains 14 contained in the grinding wheel 10 is denoted by LO, the radius R2 of the abrasive grains 12 for dressing and the radius R1 of the abrasive grains 14 contained in the grinding wheel 10 can be expressed as follows:

$$R2=S/2$$

$$R1=SO/2 \quad (1)$$

Further, as shown in FIGS. 4 and 5, the assumption is made that an abrasive grain 12 for dressing with a center C4 is mounted on three abrasive grains 14 contained in the grinding wheel 10 with a center C1, C2 and C3, respectively and arranged at three apices of a regular triangle having each side length of the average abrasive grain intervals LO.

Further, when a triangle as defined by three points C1, B, and C4 in FIG. 6 (which is a cross-sectional view taken along the line A—A shown in FIG. 5) are taken into account, since the length between C1 and C4 can be expressed as (R1+R2) and further the length between C4 and B can be expressed as (R2−R1), if the length between C1 and B is denoted by L1, the following relationship can be obtained:

$$R2-R1=\{(R1+R2)^2-L1^2\}^{1/2} \quad (2)$$

On the other hand, when the triangle as defined by three points C1, D (C4) and B in FIG. 5 is noticed, the length L1 between C1 and C4 (B) can be expressed by using L0 as follows:

$$L1=\tfrac{2}{3}^{1/2}\times LO/2=LO/3^{1/2} \quad (3)$$

Therefore, on the above-mentioned formulae (1), (2) and (3), the following relationship can be obtained:

$$S=LO^2/3SO \quad (4)$$

Accordingly, in the method of dressing the grinding wheel according to the present invention, the upper limit of the grain diameter of the abrasive grains 12 for dressing dispersed in the coolant W can be decided on the basis of the above formula (4) as follows:

$$S<LO/3SO \quad (5)$$

On the other hand, when the grain diameter of the abrasive grains 12 for dressing are excessively small, since the abrasive grains 12 for dressing enter deep between the abrasive grains 14 contained in the grinding wheel, there exists a problem in that the binding material 15 of the grinding wheel 10 is cut away excessively deep so that the abrasive grains 14 contained in the grinding wheel 10 may be dropped out. Therefore, the grain diameter of the abrasive grains 12 for dressing are determined Larger than the space between the abrasive grains 14 contained in the grinding wheel 10.

Therefore, the lower limit of the grain diameter S of the abrasive grains 12 for dressing are set by using the average abrasive grain intervals LO and the average grain diameter SO of the abrasive grains 14 contained in the grinding wheel 10 as follows:

$$(LO-SO)<S \quad (6)$$

In other words, in the method of dressing the grinding wheel according to the present invention, the grain diameter S of the abrasive grains 12 for dressing used for dressing the grinding wheel 10 is decided on the basis of the formulae (5) and (6) as follows:

$$(LO-SO)<S<(LO^2/3SO) \quad (7)$$

When the grain diameter of the abrasive grains 12 for dressing are decided as described above, since the abrasive grains 12 for dressing cannot enter between the abrasive grains 14 contained in the grinding wheel 10 perfectly, it is possible to dress the grinding wheel 10 without dropping out the abrasive grains 14 contained in the grinding wheel 10. In addition, since the abrasive grains 12 for dressing can enter from the surface 13 of the grinding wheel 10 into at least a position deeper than the average grain diameter SO of the abrasive grains 14 contained in the grinding wheel 10, it is possible to dress the grinding wheel 10 effectively.

Further, in the method of dressing the grinding wheel according to the present invention, when the grinding wheel 10 is trued by using a truing tool 11, the coolant W into which the abrasive grains 12 for dressing are dispersed is fed into a space between the truing tool 11 and the surface 13 of the grinding wheel 10 in such a way that the grinding wheel 10 can be dressed by intervening the abrasive grains 12 for dressing between the two. There-fore, it is possible to easily dress the grinding wheel 10 containing ultra-fine abrasive grains usable for the ultra high precision processing, without being affected by the manufacturing limit of the abrasive grains for dressing, being different from the prior art dressing method using the dressing tool.

While the presently preferred embodiment of the method of dressing the grinding wheel according to the present invention has been shown and described, it is to be understood that this disclosure is only for the purpose of illustration and that various changes and modifications may be made without departing from the scope of the invention as set forth in the appended claims.

For instance, in the above-mentioned embodiment, although the abrasive grains for dressing are intervening between the truing tool 11 and the surface 13 of the grinding wheel 10 by feeding the coolant W in which the abrasive grains 12 for dressing are dispersed, it is possible to feed the abrasive grains 12 for dressing between the truing tool surface 13 and the grinding wheel 10 by using a liquid or gas which are different from the coolant W.

In this case, for instance, when the abrasive grains 12 for dressing are put into a hopper and being carried into a space between the truing tool 11 and the surface 13 of the grinding wheel 10 by using a high pressure air stream, it is possible to feed the abrasive grains 12 for dressing and the coolant W separately, so that it is possible to feed the abrasive grains 12 for dressing and the coolant W under different optimum conditions.

As described above, in the method of dressing the grinding wheel according to the present invention, since the grinding wheel can be dressed by intervening the abrasive grains for dressing between the truing tool and the surface of the grinding wheel to be dressed, it is possible to easily dress the grinding wheel containing ultra-fine abrasive grains usable for the ultra high precision processing, without being affected by the manufacturing limit of the abrasive grains for dressing.

Further, since the grinding wheel can be trued and dressed at the same time, it is possible to improve the work efficiency of both the truing and the dressing. Further, since the diameter of the abrasive grains is so selected as to satisfy the aforementioned relationship formula, it is possible to dress the grinding wheel effectively, without dropping the abrasive grains contained in the grinding wheel.

What is claimed is:

1. A method of dressing a grinding wheel, comprising:

truing the grinding wheel using a truing tool; and feeding a liquid coolant for cooling the grinding wheel and the truing tool containing dispersed abrasive grains for dressing the grinding wheel into a space between the truing tool and a surface of the grinding wheel, wherein an averaged grain diameter of said abrasive grains for dressing is selected in such a way that the following relationship is satisfied:

$$(LO-SO)<S<(L0^2/3S0)$$

where S denotes the averaged grain diameter of the abrasive grains for dressing; LO denotes an averaged grain interval of the grinding wheel; and SO denotes an average grain diameter of the grinding wheel.

2. An apparatus for dressing a grinding wheel, comprising:

driving means for rotating a grinding wheel to be trued and dressed;

a truing tool for truing the grinding wheel; and liquid coolant supplying means for supplying a liquid coolant between the truing tool and a surface of the grinding wheel, said liquid coolant cools the truing tool and the grinding wheel and contains dispersed abrasive grains for dressing the grinding wheel, wherein said liquid coolant supplying means supplies the liquid coolant containing the abrasive grains for dressing, said abrasive grains having averaged grain diameter satisfying the following relationship:

$$(LO-SO)<S<(L0^2/3S0)$$

where S denotes the averaged grain diameter of the abrasive grains for dressing; LO denotes averaged grain interval of the grinding wheel; and SO denotes averaged grain diameter of the grinding wheel.

3. A method of dressing a grinding wheel, comprising:

truing the grinding wheel using a truing tool; and feeding a liquid coolant for cooling the grinding wheel and the truing tool containing dispersed abrasive grains for dressing the grinding wheel into a space between the truing tool and a surface of the grinding wheel, wherein said liquid coolant remains in a liquid state at room temperature and atmospheric pressures in the space between the truing tool and the surface of the grinding wheel.

4. An apparatus for dressing a grinding wheel, comprising:

driving means for rotating a grinding wheel to be trued and dressed;

a truing tool for truing the grinding wheel; and liquid coolant supplying means for supplying a liquid coolant between the truing tool and a surface of the grinding wheel, said liquid coolant is for cooling the truing tool and the grinding wheel and contains dispersed abrasive grains for dressing the grinding wheel, wherein said liquid coolant supplying means supplies the liquid coolant which remains in a liquid state at room temperature and atmospheric pressures in the space between the truing tool and the surface of the grinding wheel.

5. A method of dressing a grinding wheel when the grinding wheel is trued by using a truing tool, comprising:

feeding a liquid coolant containing dispersed abrasive grains for dressing the grinding wheel, into a space between the truing tool and a surface of the grinding wheel, to cool the grinding wheel and the truing tool;

collecting the liquid coolant used for cooling the grinding wheel and the truing tool; and recirculating the collected liquid coolant for feeding it into the space between said truing tool and the surface of said grinding wheel, wherein an averaged grain diameter of the abrasive grains for dressing is selected in such a way that the following relationship is satisfied:

$$(LO-SO)<S<(L0^2/3S0)$$

where S denotes the averaged grain diameter of the abrasive grains for dressing; LO denotes an averaged grain interval of the grinding wheel; and SO denotes an average grain diameter of the grinding wheel.

6. An apparatus for dressing a grinding wheel, comprising:

driving means for rotating the grinding wheel to be trued and dressed;

a truing tool for truing the grinding wheel;

liquid coolant supplying means for supplying a liquid coolant between the truing tool and a surface of the grinding wheel, said liquid coolant being for cooling the truing tool and the grinding wheel and containing dispersed abrasive grains for dressing the grinding wheel;

liquid coolant collecting means for collecting the liquid coolant used for cooling the truing tool and the grinding wheel; and liquid coolant recirculating means for recirculating the collected liquid coolant for feeding it into the space between the truing tool and the surface of the grinding wheel, wherein said liquid coolant supplying means supplies the liquid coolant containing the abrasive grains for dressing whose averaged grain diameter satisfies the following relationship:

$$(LO-SO)<S<(L0^2/3S0)$$

where S denotes the averaged grain diameter of the abrasive grains for dressing; LO denotes averaged grain interval of the grinding wheel; and SO denotes averaged grain diameter of the grinding wheel.

* * * * *